US007051542B2

(12) United States Patent
Chen et al.

(10) Patent No.: US 7,051,542 B2
(45) Date of Patent: May 30, 2006

(54) TRANSCRITICAL VAPOR COMPRESSION OPTIMIZATION THROUGH MAXIMIZATION OF HEATING CAPACITY

(75) Inventors: Yu Chen, East Hartford, CT (US); Tobias H. Sienel, Easthampton, MA (US); Lili Zhang, East Hartford, CT (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/738,657

(22) Filed: Dec. 17, 2003

(65) Prior Publication Data

US 2005/0132735 A1 Jun. 23, 2005

(51) Int. Cl.
*F25B 13/00* (2006.01)
*F25B 41/04* (2006.01)
*F25D 17/00* (2006.01)

(52) U.S. Cl. ..... 62/160; 62/180; 62/223; 62/224

(58) Field of Classification Search ..... 62/160, 62/185, 201, 217, 222, 223, 224, 180
See application file for complete search history.

(56) References Cited

U.S. PATENT DOCUMENTS 4,944,156 A * 7/1990 Yamamoto ..... 62/324.6
5,052,186 A * 10/1991 Dudley et al. ..... 62/79
5,669,223 A * 9/1997 Haley et al. ..... 62/160
5,704,219 A * 1/1998 Suzuki et al. ..... 62/222
5,878,589 A * 3/1999 Tanaka et al. ..... 62/199
5,934,094 A * 8/1999 Itoh et al. ..... 62/222
6,230,506 B1 * 5/2001 Nishida et al. ..... 62/223
6,332,496 B1 * 12/2001 Takano et al. ..... 165/202
2004/0079096 A1 * 4/2004 Itoh et al. ..... 62/223

FOREIGN PATENT DOCUMENTS

JP 60044747 A * 3/1985
JP 03095340 A * 4/1991
JP 03213937 A * 9/1991
JP 03213938 A * 9/1991
JP 2000346448 12/2000
JP 2001082803 3/2001
JP 2002147846 5/2002
JP 2002310519 10/2002

* cited by examiner

*Primary Examiner*—Marc Norman
(74) *Attorney, Agent, or Firm*—Carlson, Gaskey & Olds

(57) ABSTRACT

A vapor compression system includes a compressor, a gas cooler, an expansion device, and an evaporator. Refrigerant is circulated through the system. The high side pressure of the vapor compression system is selected to optimize the heating capacity. In one example, the optimal high side pressure is obtained by determining the high side pressure that correlates to the maximum current required to operate to the water pump. In another example, the actual temperature of the water entering the gas cooler, the water exiting the gas cooler, and the ambient air temperature are measured and compared to a predetermined value to determine the optimal high side pressure.

19 Claims, 2 Drawing Sheets

TRANSCRITICAL VAPOR COMPRESSION OPTIMIZATION THROUGH MAXIMIZATION OF HEATING CAPACITY

BACKGROUND OF THE INVENTION

The present invention relates generally to a system and method of optimizing a transcritical vapor compression system by maximizing the system heating capacity.

Chlorine containing refrigerants have been phased out in most of the world due to their ozone destroying potential. Hydrofluorocarbons (HFCs) have been used as replacement refrigerants, but these refrigerants still have high global warming potential.

"Natural" refrigerants, such as carbon dioxide and propane, have been proposed as replacement fluids. Carbon dioxide can be used as a refrigerant in automotive air conditioning systems and other heating and cooling applications. Carbon dioxide has a low critical point, which causes most air conditioning systems utilizing carbon dioxide as a refrigerant to run transcritically, or partially above the critical point, under most conditions.

A vapor compression system must be able to provide enough heating capacity to meet the load requirements during the winter when the outdoor air temperature is the lowest. For a given set of operating conditions, there is a high side pressure value which maximizes the coefficient of performance. A different high side pressure value for the same set of operating conditions maximizes the heating capacity. The high side pressure is generally selected to optimize the coefficient of performance. The coefficient of performance is very sensitive to the high side pressure when the high side pressure of the system is set below the high side pressure that optimizes the coefficient of performance. However, the coefficient of performance becomes insensitive to the high side pressure when the high side pressure of the system is set above the optimal high side pressure.

In prior vapor compressions systems, the vapor compression system is oversized to achieve sufficient heating capacity in low ambient conditions. A drawback to oversizing a vapor compression system is that it is expensive and requires more space.

Hence, there is a need in the art for a system and method of optimizing the heating capacity of a vapor compression system as well as overcoming the disadvantages of the prior art.

SUMMARY OF THE INVENTION

A transcritical vapor compression system includes a compressor, a gas cooler, an expansion device, and an evaporator. Refrigerant is circulated though the closed circuit cycle. In one example, the refrigerant is carbon dioxide. Carbon dioxide has a low critical point, and systems utilizing carbon dioxide as the refrigerant usually operate transcritically. In the present invention, high pressure of the vapor compression system is regulated to optimize the heating capacity of the system.

In one example system, the optimal heating capacity of the vapor compression system is determined by measuring the current required to operate the water pump that pumps water through the gas cooler to accept heat from the refrigerant. The higher the current required to operate the water pump, the higher the flowrate of the water through the gas cooler, and the higher the heat exchange between the water and the refrigerant in the gas cooler. That is, the higher the current to operate the water pump, the higher the heating capacity of the system. At a given high side pressure, the heating capacity is calculated based upon the measured current required to operate the heat pump. The high side pressure of the system is continually adjusted and current readings of the heat pump are obtained until the maximum current, and therefore optimal heating capacity, is obtained.

In another example system, the heating capacity of the vapor compression system is maximized by regulating the high side pressure based upon several measured system characteristics. The ambient air temperature, the inlet temperature of the heat sink of the gas cooler and the outlet temperature of the heat sink of the gas cooler are measured. A controller then correlates the measured temperatures to a pre-determined high pressure side programmed in the controller that obtains the optimal heating capacity for the given operating conditions. Based on this analysis, the controller adjusts the orifice of the expansion device to regulate the high side pressure in the system to achieve the pre-determined optimal heating capacity.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
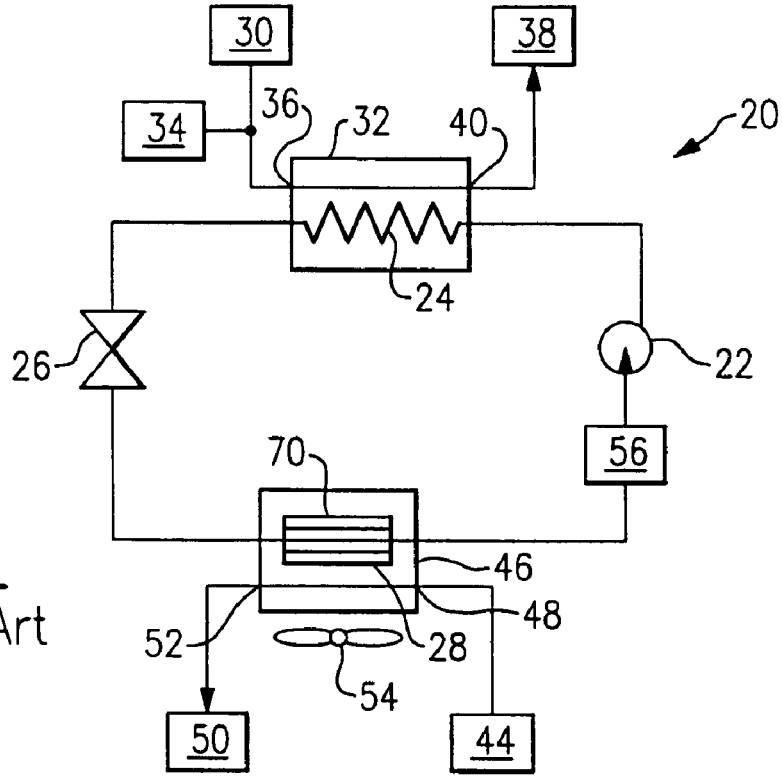
FIG.1 Prior Art
FIG. 1 schematically illustrates a diagram of a prior art vapor compression system.

FIG. 1 illustrates an example vapor compression system 20 that includes a compressor 22, a heat rejecting heat exchanger (a gas cooler in transcritical cycles) 24, an expansion device 26, and a heat accepting heat exchanger (an evaporator) 28. Refrigerant circulates through the closed circuit system 20.

The refrigerant exits the compressor 22 at a high pressure and a high enthalpy. The refrigerant then flows through the gas cooler 24 at a high pressure. A fluid medium 30, such as water or air, flows through a heat sink 32 of the gas cooler 24 and exchanges heat with the refrigerant flowing through the gas cooler 24. In the gas cooler 24, the refrigerant rejects heat into the fluid medium 30, and the refrigerant exits the gas cooler 24 at a low enthalpy and a high pressure. A water pump 34 pumps the fluid medium through the heat sink 32. The cooled fluid medium 30 enters the heat sink 32 at the heat sink inlet or return 36 and flows in a direction opposite to or cross to the direction of the flow of the refrigerant. After exchanging heat with the refrigerant, the heated water 38 exits the heat sink 32 at the heat sink outlet or supply 40.

The refrigerant then passes through the expansion device 26, which regulates the pressure of the refrigerant. The expansion device 26 can be an electronic expansion valve (EXV) or other known type of expansion device.

After passing through the expansion valve, the refrigerant flows through the passages 70 of the evaporator 28 and exits at a high enthalpy and a low pressure. In the evaporator 28, the refrigerant absorbs heat from a heated fluid medium 44, heating the refrigerant. In one example, the heated fluid medium 44 is outdoor air. The heated fluid medium 44 flows through a heat sink 46 and exchanges heat with the refrigerant passing through the evaporator 28 in a known manner. The heated fluid medium 44 enters the heat sink 46 through the heat sink inlet or return 48 and flows in a direction opposite or cross to the direction of flow of the refrigerant. After exchanging heat with the refrigerant, the cooled fluid medium 50 exits the heat sink 46 through the heat sink outlet or supply 52. The temperature difference between the heated fluid medium 44 and the refrigerant in the evaporator 28 drives the thermal energy transfer from the heated fluid medium 44 to the refrigerant as the refrigerant flows through the evaporator 28. A fan 54 moves the heated fluid medium 44 across the evaporator 28, maintaining the temperature difference and evaporating the refrigerant. The refrigerant then reenters the compressor 22, completing the cycle.

The system 20 transfers heat from the low temperature energy reservoir (ambient air) to the high temperature energy sink (heated hot water). The transfer of energy is also achieved with the aid of electrical energy input at the compressor 22.

The system 20 can also include an accumulator 56. The accumulator 56 stores excess refrigerant from the system 20.

In one example, carbon dioxide is used as the refrigerant. Although carbon dioxide is described, other refrigerants may be used. Because carbon dioxide has a low critical point, systems utilizing carbon dioxide as a refrigerant usually run transcritically.

The heating capacity of a vapor compression system 20 is defined as the capacity of the system 20 to heat the fluid medium 30 that flows through the gas cooler 24 and accepts heat from the refrigerant flowing through the gas cooler 24. A vapor compression system 20 usually operates under a wide range of operating conditions. For example, the temperature of the heated fluid medium 44, which in this example is outdoor air, can vary between −10° F. in the winter and 120° F. in the summer. This can cause the temperature of the refrigerant exiting the evaporator 28 to vary between approximately −20° F. and 90° F. Therefore, the heating capacity of the vapor compression system 20 in the summer is generally four to five times greater than the heating capacity of the vapor compression system 20 in the winter, and the refrigerant mass flow rate of the vapor compression system 20 in the summer is generally eight to ten times greater than the refrigerant mass flow rare of the vapor compression system 20 in the winter. Although the heating capacity of the vapor compression system 20 changes as operating conditions change, the heating load required of the vapor compression system 20 does not change as the ambient temperature changes.

Figure 2:
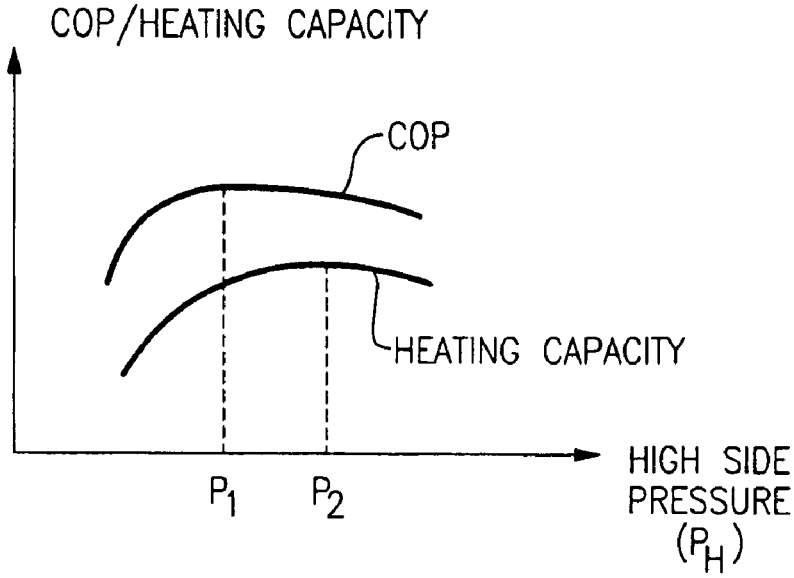
FIG. 2 schematically illustrates a graph relating the high side pressure to both system performance and system heating capacity.

FIG. 2 graphically illustrates the high side pressure of a vapor compression system 20 as it relates to both the system coefficient of performance and the system heating capacity. The horizontal axis represents the high side pressure of the system and the vertical axis represents both the coefficient of performance and the heating capacity of the system. The relationship between the high side pressure and the heating capacity is illustrated, and the relationship between the high side pressure and the coefficient of performance is also illustrated. The high side pressure that maximizes the system coefficient of performance is shown as $P_1$, and the high side pressure that maximizes the system heating capacity is shown as $P_2$.

As the high side pressure increases to $P_1$, both the heating capacity and the coefficient of performance increase significantly. At $P_1$, the coefficient of performance is maximized. As the high side pressure increases from $P_1$ to $P_2$, the heating capacity continues to increase significantly while the coefficient of performance decreases only slightly. At $P_2$, the heating capacity is optimized, but the coefficient of performance has only negligibly decreased.

In the present invention, the system 20 operates in an optimizing heating capacity when a sensor 60 (shown in FIGS. 3 and 4) detects that the temperature of the heated medium 44 is below a threshold value, In one example, the threshold value is 32° F.

When the sensor 60 detects that the temperature of the heated fluid medium 44 is above the threshold value, the system 20 operates in a normal mode. That is, the system 20 operates to optimize the coefficient performance. When the sensor 60 detects that the temperature of the heated fluid medium 44 is below the threshold value, the system 20 operates in a heating capacity mode. When operating in the heating capacity mode, the heating capacity is optimize by determining the optimal system heating capacity pressure $P_2$, measuring the actual system high side pressure $P_H$, and then regulating the actual system high side pressure $P_H$ to the optimal system heating capacity pressure $P_2$.

Figure 3:
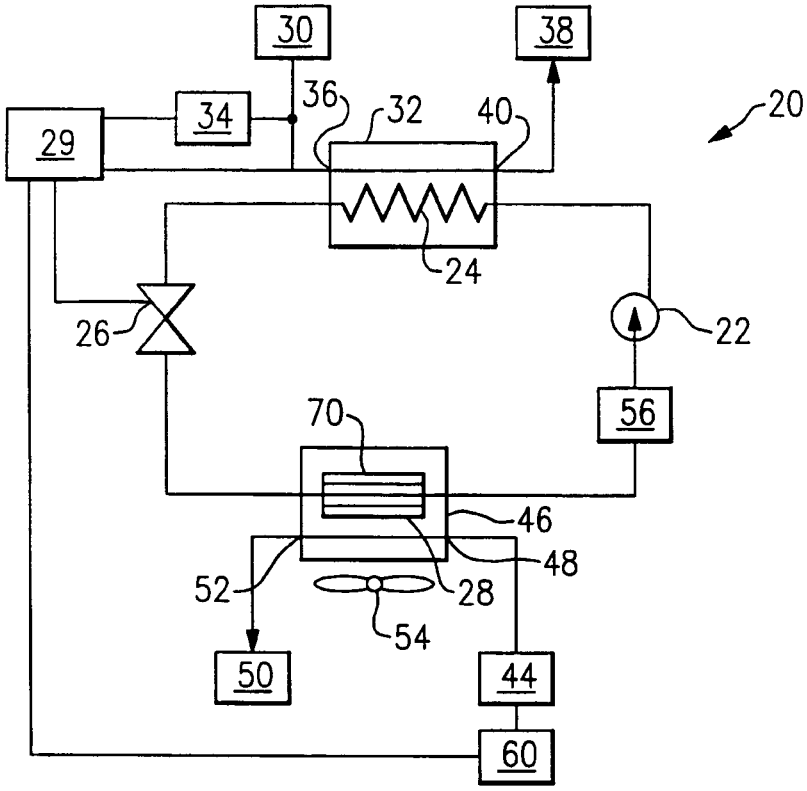
FIG. 3 schematically illustrates a diagram of a first embodiment of a vapor compression system.

FIG. 3 illustrates a first embodiment of the present invention. The optimal heating capacity of the vapor compression system 20 is determined by measuring the current required to operate the water pump 34. The water pump 34 pumps the cooled fluid medium 30 through the gas cooler 24 at a flowrate. In the gas cooler 24, the cooled fluid medium 30 accepts heat from the refrigerant exiting the compressor 22. The higher the current required to operate the water pump 34, the higher the flowrate of cooled fluid medium 30 by the water pump 34, the higher the heat transfer between the fluid medium 30 and the refrigerant in the gas cooler 24, and the higher the heating capacity. That is, as the current to operate the water pump 34 increases, the system heating capacity increases.

A controller 29 regulates the system 20. At a given high side pressure, the heating capacity can be calculated based on the current measured to operate the water pump 34. The controller 29 stores the calculated heating capacity value at the given high side pressure. The calculated hearing capacity is compared to a stored value of system heating capacity. The high side pressure of the system 20 is continually changed until the current that operates the pump 34 is the greatest. When the maximum current is determined, the corresponding high side pressure is the pressure that optimizes the heating capacity. The system 20 is run at this high side pressure to maximize capacity.

For example, the high side pressure can be set to 1500 psi. At this high side pressure,the controller 29 detects that the water pump 34 is using 10 milliamps of current. The high side pressure is then adjusted to at 1550 psi. The controller 29 then detects that the water pump 34 is using 10.5 miilliamps of current. The high side pressure is then adjusted to 1600 psi. The controller 29 then detects that the water pump 34 is using 10.2 milliamps of current. In this example, the water pump 34 uses the highest amount of current when system is operating at a high side pressure of 1550 psi. Therefore, at this high side pressure, the heating capacity of the system 20 is optimized.

Figure 4:
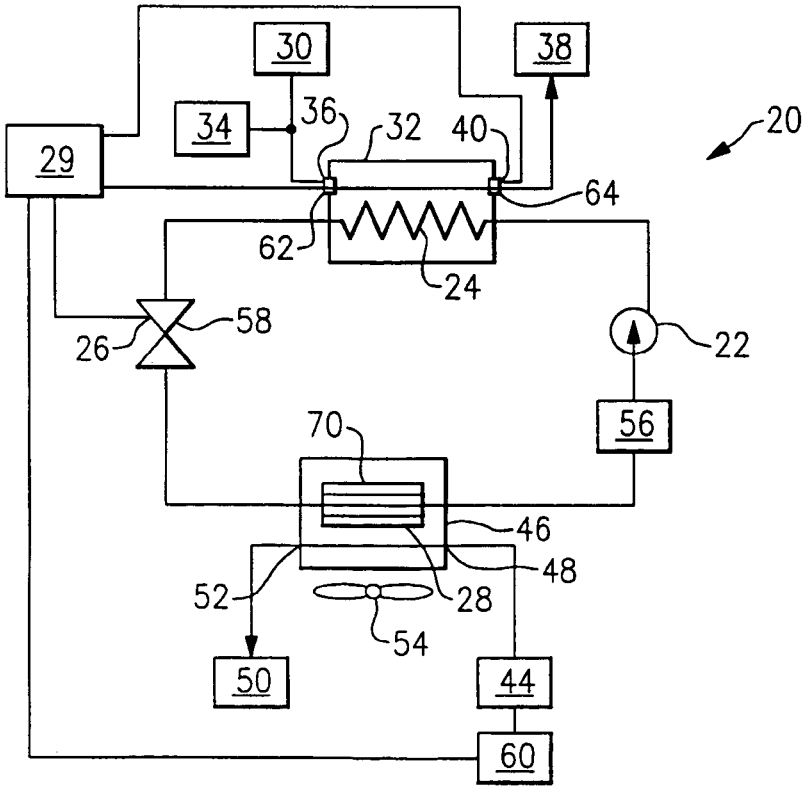
FIG. 4 schematically illustrates a diagram of a second embodiment of a vapor compression system.

FIG. 4 illustrates a second embodiment of the present invention. Three system characteristics are measured to determine the optimal system heating capacity pressure $P_2$. A water inlet temperature sensor 62 detects a water inlet temperature of the fluid medium 30 entering the gas cooler 24, a water outlet temperature sensor 64 detects a water outlet temperature of the water 38 exiting the gas cooler 24, and an ambient air temperature sensor 60 detects a heated fluid medium temperature, which in this example is an ambient air 44 temperature. The three temperatures detected by sensors 60, 62, and 64 are communicated to and collected by the controller 29.

Optimal high side pressure values for various temperatures are programmed and stored in the controller 29. Based on the detected temperatures, an optimal high side pressure is determined. Alternately, the optimal size or percentage of the orifice of the expansion device 26 is determined based on the detected temperatures. Alternately, the control current for the expansion valve 26 is determined based on the detected temperatures.

The actual system high side pressure $P_H$ is then regulated to achieve the optimal system heating capacity pressure $P_2$. The actual system high side pressure $P_H$ can be regulated by adjusting an orifice 58 of the expansion device 26. Opening the orifice 58 increases the flowrate of the refrigerant through the expansion device 26, causing more mass to leave the high pressure part of the system, decreasing the instantaneous refrigerant mass in the high pressure part of the system, and decreasing the system high side pressure $P_H$. Closing the orifice decreases the flowrate of the refrigerant through the expansion device 26, causing less mass to leave the high pressure part of the system, increasing the instantaneous refrigerant mass in the high pressure part of the system, and increasing the system high side pressure $P_H$. The system high side pressure $P_H$ can be regulated in other ways, and one skilled in the art would know how to regulate the high side pressure.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A method of optimizing a heating capacity of a vapor compression system comprising the steps of:

sensing a temperature of an outdoor fluid medium;

measuring a current required to operate a pumping device, wherein the pumping device pumps a fluid through a heat exchanger and the fluid exchanges heat with a refrigerant in the heat exchanger; and optimizing the heating capacity based upon the current measured when the step of sensing determines that the temperature is below a threshold value.

2. The method of claim 1, wherein the hear exchanger is a heat rejecting heat exchanger, the method further including the steps of compressing the refrigerant to a high pressure, cooling the refrigerant in the heat rejecting heat exchanger, expanding the refrigerant to a low pressure in an expansion device and evaporating the refrigerant in a heat accepting heat exchanger, wherein the step of evaporating the refrigerant includes accepting heat from the outdoor fluid medium.

3. The method of claim 2 further including the steps of determining an optimal heating capacity pressure and adjusting a high side pressure of the vapor compression system to the optimal heating capacity pressure.

4. The method of claim 3 wherein the step of cooling the refrigerant further includes exchanging heat between the refrigerant and the fluid pumped by the pumping device.

5. The method of claim 3 wherein the optimal heating capacity pressure is based on at least one measured system characteristic.

6. The method of claim 5 wherein the at least one measured system characteristic is at least one of an ambient temperature, a fluid inlet temperature of the fluid entering the heat rejecting heat exchanger, and a fluid outlet temperature of the fluid exiting the heat rejecting heat exchanger.

7. The method of claim 6 further including a control, wherein the at least one measured system characteristic and the optimal heating capacity pressure are correlated by the control.

8. The method of claim 5 wherein the step of sensing further includes determining an optimal size of an orifice of the expansion device based on the at least one measured system characteristic.

9. The method of claim 8 wherein the at least one measured system characteristic is at least one of an ambient temperature, a fluid inlet temperature of the fluid entering the heat rejecting heat exchanger, and a fluid outlet temperature of the fluid exiting the heat rejecting heat exchanger.

10. The method of claim 5 wherein the step of sensing further includes determining an optimal control current of the expansion device based on the at least one measured system characteristic.

11. The method of claim 10 wherein the at least one measured system characteristic is at least one of an ambient temperature, a fluid inlet temperature of the fluid entering the heat rejecting heat exchanger, and a fluid outlet temperature of the fluid exiting the heat rejecting heat exchanger.

12. The method of claim 1 wherein the refrigerant is carbon dioxide.

13. The method of claim 1 further including the steps of cooling the refrigerant by exchanging heat between the refrigerant and the fluid pumped by the pumping device, determining a maximum current supplied to the pumping device, determining an optimal heat capacity pressure by correlating the maximum current supplied to the pumping device to the optimal heating capacity pressure and adjusting a high side pressure of the vapor compression system to the optimal heating capacity pressure.

14. The method of claim 13, wherein the fluid is water.

15. A method of optimizing a heating capacity of a vapor compression system comprising the steps of:

sensing a temperature of an outdoor fluid medium;

cooling a refrigerant in a heat rejecting heat exchanger with a fluid;

detecting a fluid inlet temperature of the fluid at an inlet of the heat rejecting heat exchanger;

detecting a fluid outlet temperature of the fluid at an outlet of the heat rejecting heat exchanger;

optimizing the heating capacity when the step of sensing determines that the temperature is below a threshold value;

determining an optimal heating capacity pressure based upon the inlet fluid temperature and the outlet fluid temperature; and adjusting a high side pressure of the vapor compression system to achieve the optimal heating capacity pressure.

16. The method of claim 15 further including the step of determining the high side pressure.

17. The method of claim 15 further including the step of determining an optimal coefficient of performance pressure, wherein the optimal heating capacity pressure is greater than the optimal coefficient of performance pressure, and the step of adjusting the high side pressure includes adjusting the high side pressure to a value greater than the optimal coefficient of performance pressure and less than the optimal heating capacity pressure.

18. The method of claim 15 further including the steps of compressing the refrigerant to a high pressure, cooling the refrigerant in a heat rejecting heat exchanger, expanding the refrigerant to a low pressure in an expansion device and evaporating the refrigerant in a heat accepting heat exchanger, wherein the step of evaporating the refrigerant includes accepting heat from the outdoor fluid medium.

19. The method of claim 15 wherein the refrigerant is carbon dioxide.

* * * * *

UNITED STATES PATENT AND TRADEMARK OFFICE

CERTIFICATE OF CORRECTION

PATENT NO. : 7,051,542 B2
APPLICATION NO. : 10/738657
DATED : May 30, 2006
INVENTOR(S) : Chen et al.

It is certified that error appears in the above-identified patent and that said Letters Patent is hereby corrected as shown below:

IN THE CLAIMS:

Column 5, Line 62 of the issued patent, “hear” should read ass --heat--.

Signed and Sealed this

Twenty-sixth Day of September, 2006

JON W. DUDAS
*Director of the United States Patent and Trademark Office*

UNITED STATES PATENT AND TRADEMARK OFFICE

CERTIFICATE OF CORRECTION

PATENT NO. : 7,051,542 B2
APPLICATION NO. : 10/738657
DATED : May 30, 2006
INVENTOR(S) : Chen et al.

It is certified that error appears in the above-identified patent and that said Letters Patent is hereby corrected as shown below:

IN THE CLAIMS:

Column 5, Line 62 of the issued patent, “hear” should read ass --heat--.

Signed and Sealed this

Thirty-first Day of October, 2006

JON W. DUDAS
*Director of the United States Patent and Trademark Office*